United States Patent [19]

Harada

[11] 4,057,043

[45] Nov. 8, 1977

[54] EXHAUST GAS RECIRCULATION SYSTEM

[75] Inventor: Tetsuya Harada, Yokohama, Japan

[73] Assignee: Nissan Motor Co., Ltd., Japan

[21] Appl. No.: 694,944

[22] Filed: June 11, 1976

[30] Foreign Application Priority Data

June 13, 1975 Japan ..... 50-80387[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,722,927 | 11/1955 | Cornelius | 123/119 A |
| 3,814,070 | 6/1975 | Wertheimer | 123/119 A |
| 3,835,827 | 9/1974 | Wolgemuth | 123/119 A |
| 3,885,536 | 5/1975 | Marshall | 123/119 A |
| 3,926,161 | 12/1975 | Wertheimer | 123/119 A |
| 3,931,813 | 1/1976 | Horie et al. | 123/119 A |
| 3,973,535 | 8/1976 | Sugihara et al. | 123/119 A |
| 4,009,700 | 3/1977 | Engels | 123/119 A |
| 4,013,052 | 3/1977 | Masaki et al. | 123/119 A |

*Primary Examiner*—Wendell E. Burns

*Attorney, Agent, or Firm*—Robert E. Burns; Emmanuel J. Lobato; Bruce L. Adams

[57] ABSTRACT

An additional vacuum servo is provided to be associated with a vacuum servo of an air supply control valve controlling the amount of atmospheric air fed into a vacuum actuator of an EGR control valve and is operable, in response to the vacuum in the vacuum actuator reduced by the fed atmospheric air, to minutely adjust the degree of opening of the air supply control valve to minutely adjust the amount of the atmospheric air fed into the vacuum actuator.

10 Claims, 5 Drawing Figures

EXHAUST GAS RECIRCULATION SYSTEM

The present invention relates generally to an improvement in an exhaust gas recirculation (EGR) system comprising an EGR control valve including a vacuum actuator which is fed with atmospheric air to reduce the vacuum therein during engine low load operation and particularly to an EGR system of this type which is improved to provide an expedient for preventing the vacuum actuator from being fed with an excessive amount of atmospheric air.

As is well known in the art, there is provided an exhaust gas recirculation (EGR) system of a type comprising an EGR control valve the degree of opening of which is controlled by a vacuum fed into a vacuum actuator from a vacuum taking-out port formed in the intake passageway at a position varied from upstream of the throttle valve into downstream thereof as the degree of opening of the throttle valve is increased. The EGR control valve is required to meter the amount of engine exhaust gases fed into the intake passageway to a predetermined ratio to the amount of air drawn into the intake passageway. If an excessive amount of engine exhaust gases are fed into the intake passageway, combustion of an air-fuel mixture in the engine is rendered unstable to degrade the performance of the engine, while if an insufficient amount of engine exhaust gases are fed into the intake passageway, the temperature of combustion of the air-fuel mixture is increased beyond an allowable temperature range to cause or increase the production of nitrogen oxides (NOx). Under such a requirement, if the EGR control valve is controlled by only a vacuum from the vacuum taking-out port, the amount of engine exhaust gases fed into the intake passageway becomes surplus or scanty to the amount of air drawn into the engine. Especially, the EGR control valve is largely opened and an excessive amount of engine exhaust gases are drawn into the intake passageway by an increased intake manifold vacuum and through the largely opened EGR control valve during engine low load operating condition. As a solution to such a problem, the EGR system of the last-mentioned type is provided with passage means for feeding atmospheric air into the vacuum actuator of the EGR control valve, and an air supply control valve associated with the passage means and operable in response to the vacuum in the intake passageway downstream of the throttle valve to control the amount of atmospheric air fed or drawn into the vacuum actuator. The atmospheric air fed by this provision reduces the vacuum in the vacuum actuator to prevent the EGR control valve from being greatly opened and to prevent engine exhaust gases from being excessively drawn into the intake passageway during engine low load operating condition.

However, the EGR system with the provision has had a drawback that the air supply control valve fails to minutely or satisfactorily adjust the amount of atmospheric air fed into the vacuum actuator and as a result of the EGR control valve fails to meter the amount of engine exhaust gases fed into the intake passageway to a predetermined ratio to the amount of air drawn into the engine. It is believed that this is because the air supply control valve is operated so that atmospheric air is excessively or scantly fed into the vacuum actuator to abruptly reduce or fail to reduce the vacuum therein.

It is, therefore, an object of the invention to provide an EGR system which surely meters the amount of engine exhaust gases fed into the intake passageway to a predetermined ratio to the amount of air fed into the engine by providing an expedient operated by an intake passageway vacuum, reduced by atmospheric air, to minutely or satisfactorily adjust the degree of opening of the air supply control valve or the cross sectional area of the passage of atmospheric air fed to the vacuum actuator to supply a desirable amount of atmospheric air thereinto.

This and other objects and advantages of the invention will become more apparent from the following detailed description taken in connection with the accompanying drawings in which.

Figure 1:
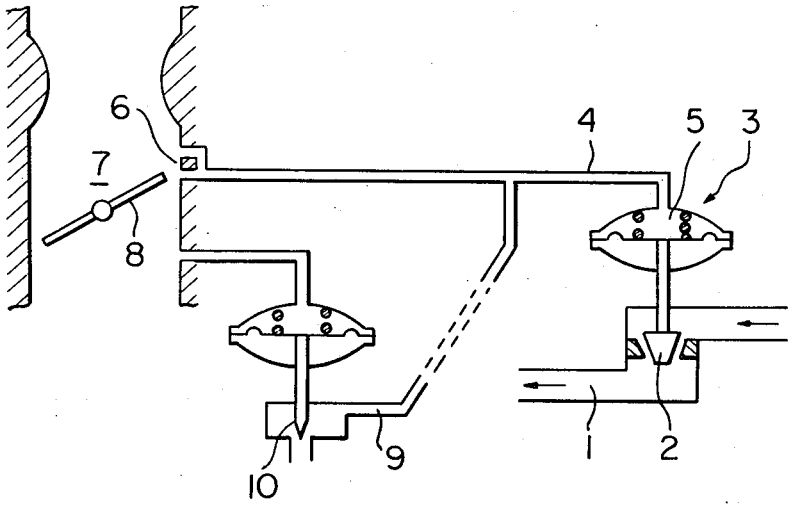
FIG. 1 is a schematic cross sectional view of a prior art exhaust gas recirculation (EGR) system as per the introduction of the present specification.

Referring to FIG. 1 of the drawings, there is shown a prior art exhaust gas recirculation (EGR) system as per the introduction of the present specification. The prior art EGR system is shown to comprise an exhaust gas recirculation (EGR) passage 1, an exhaust gas recirculation (EGR) control valve 2 disposed in the EGR passage 1, a vacuum actuator 3 for operating the EGR control valve 2, passage means 4 interconnecting a vacuum chamber 5 of the vacuum actuator 3 and a vacuum taking-out port 6 of an engine intake passageway 7 which port is varied from upstream of a throttle valve 8 into downstream thereof as the degree of opening of the throttle valve 8 is increased, passage means 9 for feeding atmospheric air into the passage means 4, and an air supply control valve 10 for controlling the amount of atmospheric air fed into the passage means 4 through the passage means 9.

Figure 2:
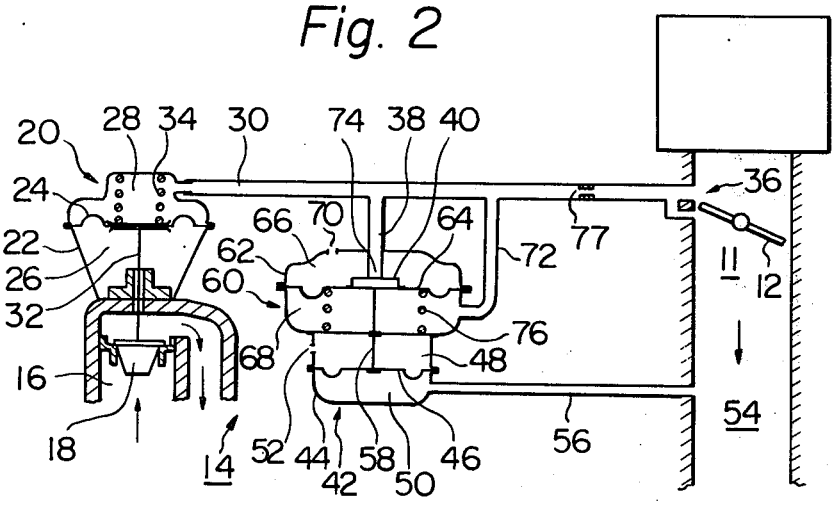
FIG. 2 is a schematic cross sectional view of a preferred embodiment of an exhaust gas recirculation (EGR) system according to the invention.

Referring to FIG. 2 of the drawings, there is shown an exhaust gas recirculation system according to the invention which is combined with an intake passageway 11 providing communication between the atmosphere and an intake port (not shown) of an internal combustion engine (not shown). The intake passageway 11 has a throttle valve 12 rotatably mounted therein.

The exhaust gas recirculation (EGR) system, generally designated by the reference numeral 14, comprises an exhaust gas recirculation (EGR) passage or conduit 16 communicating at one end with an exhaust gas passageway (not shown) of the engine and at the other end with the intake passageway 11 downstream of the throttle valve 12 or an intake manifold (not shown) of the engine and conducting exhaust gases emitted from the engine into the intake passageway 11 or intake manifold. In FIG. 2, the EGR passage 16 is partially shown. An exhaust gas recirculation (EGR) control valve 18 is disposed in the EGR passage 16. A vacuum actuator 20 is provided to operate the EGR control valve 18 in such a manner that it meters the flow or amount of the engine exhaust gases conducted to the intake passageway 11 at a predetermined ratio to the flow or amount of air drawn into the intake passageway 11 or intake manifold. The vacuum actuator 20 includes a housing 22, a flexible diaphragm 24 dividing the interior of the housing 22 into first and second chambers 26 and 28, which communicate respectively with the atmosphere and with the intake passageway 11 through a conduit or passage 30. The diaphragm 24 is operatively connected to the EGR control valve 18b through an actuating rod 32 and is operable or deformable in response to an increase and a decrease in the vacuum in the vacuum chamber 28 to cause an increase and a decrease in the degree of opening of the EGR control valve 18. Biasing means such as a spring 34 is provided to urge the diaphragm 24 toward a position in which the EGR control valve 18 closes the EGR passage 16. The conduit 30 opens into the intake passageway 11 adjacent to the throttle valve 12 through a vacuum taking-out port 36 which is formed at a position which is varied from upstream of the throttle valve 12 into downstream thereof as the degree of opening of the throttle valve 12 is increased.

The EGR system 14 also comprises passage or conduit means 38 which communicate at one end with the atmosphere and at the other end with the conduit 30 and feeds atmospheric air into the conduit 30 and accordingly the vaccum chamber 28 of the vacuum actuator 20. The passage means 38 may be connected to the vacuum chambe4 28 to directly communicate with or open into the same. An air supply control valve or a vacuum regulating valve 40 is provided to be associated with the passage means 38 and to control the amount of atmospheric air fed into the vacuum chamber 28 to adjust the level of the vacuum therein. First operating means or a first vacuum actuator or servo 42 is provided to operate the control valve 40 in such a manner that the control valve 40 normally closes the passage means 38 to inhibit atmospheric air to enter the vacuum chamber 28 and opens it when the engine is running under a low load condition to allow atmospheric air to enter the vacuum chamber 28 and to reduce the vacuum therein to prevent the engine exhaust gases from being excessively fed or drawn into the intake passageway by an increased intake passageway vacuum. The vacuum actuator 42 includes a housing 44 and a flexible diaphragm 46 dividing the interior of the housing 44 into first and second chambers 48 and 50. The first chamber 48 communicates with the atmosphere through a vent port 52, while the second chamber 50 communicates with the intake passage 11 at a section 54 downstream of the throttle valve 12 or the intake manifold through a conduit or passage 56 so that the second chamber 50 is fed with the vacuum in the intake passageway 11 at the section 54 which is referred to as the intake passageway vacuum or intake manifold vacuum hereinafter. The diaphragm 46 is operatively connected to the control valve 40 through an actuating rod 58 and is operable or deformable in response to an increase and a decrease in the intake passageway vacuum to cause an increase and a decrease in the degree of opening of the control valve 40.

Additional or second operating means or vacuum actuator or servo 60 is provided to prevent the control valve 40 from being excessively opened by the first operating means 42 and comprises a housing 62 fixedly connected to the housing 44 of the vacuum servo 42 and a flexible diaphragm 64 dividing the interior of the housing 62 into first and second chambers 66 and 68. The first chamber 66 communicates with the atmosphere through a vent port 70, while the second chamber 68 communicates with the conduit 30 through a conduit or passage 72. The conduit 72 may be connected to the conduit 30 at a position upstream of the junction between the conduits 30 and 38 as shown in FIG. 2. The diaphragm 64 is operatively connected to the operating rod 58 and is deformable or operable in response to an increase and a decrease in the vacuum in the second chamber 68 to cause an increase and a decrease in the degree of opening of the control valve 40. In this embodiment the diaphragm 64 is directly connected to the valve head of the control valve 40. Accordingly, the valve head of the control valve 40 is located in the first chamber 66 and the passage means 38 extends thereinto. As a result, the construction and arrangement of the control valve 40 and the operating means 42 and 60 are rendered compact and simple. The inlet end 74 of the passage means 38 and the valve head of the control valve 40 may be located externally of the chamber 66 or the housing 62 so that the operating rod 58 extends through the housing 62. The vacuum actuators 42 and 60 may be positioned reversely to the relative position shown in FIG. 2. Biasing means such as a spring 76 is provided to urge the diaphragm 64 toward a position in which the control valve 40 closes the passage means 38. Alternatively, the spring 76 may be located to urge the diaphragm 46 toward the last-mentioned position. An orifice 77 is provided in the passage means 30 and 72 to adjust the vacuum from the vacuum taking-out port 36 to a suitable value.

Figure 3:
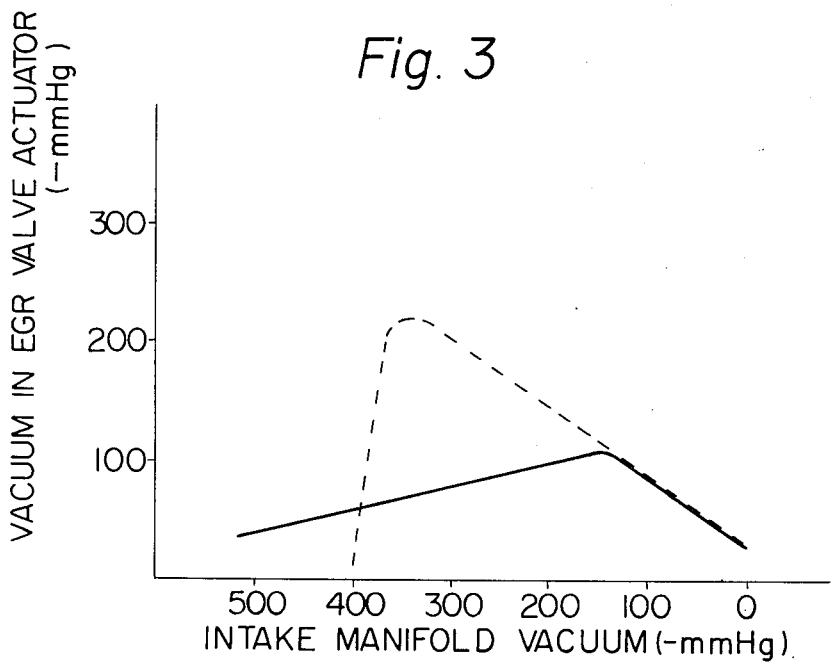
FIG. 3 is a graphic representation of the characteristics of the vacuum in each of the vacuum actuators of the EGR control valves of the prior art EGR system shown in FIG. 1 and the improved EGR system shown in FIG. 2, respectively.

The EGR system 14 thus far described is operated as follows:

Reference is further made to FIG. 3 of the drawings. FIG. 3 shows the characteristics of the vacuum in each of the vacuum chambers 5 and 28 of the vacuum actuators 3 and 20 of the prior art EGR system shown in FIG. 1 and the improved EGR system 14 shown in FIG. 2. In FIG. 3, the vacuum in the vacuum chamber 5 is designated by the dotted line, while the vacuum in the vacuum chamber 28 is designated by the solid line. The abscissa represents the intake manifold vacuum in -mmHg, while the ordinate represents the vacuum in the vacuum chambers 5 and 28 in -mmHg. As apparent from the dotted line in FIG. 3, in the prior art EGR system the air supply control valve 10 is operated so that only a scanty amount of atmospheric air is fed into the vacuum chamber 5 when the intake manifold vacuum is relatively low and an excessive amount of atmospheric air is fed into the vacuum chamber 5 when the intake manifold vacuum is relatively high.

The second operating means 60 of the improved EGR system 14 serves to increase and reduce the degree of opening of the air supply control valve 40 when the intake manifold vacuum is relatively low and high, respectively. As a result, in the improved EGR system 14 the air supply control valve 40 is operated by the first and second operating means 42 and 60 so that an adequate or desirable amount of atmospheric air is fed into the vacuum chamber 28 independently of the intake manifold vacuum being low and high, as shown by the solid line in FIG. 3.

When the intake passageway vacuum is increased as during enging low load operation, the vacuum actuator 42 causes the control valve 40 to open the passage means 38 in response to the increased intake passageway vacuum to allow atmospheric air to enter the conduit 30 and accordingly the vacuum chamber 68 of the vacuum actuator 60 through the conduit 72. Accordingly, the vacuum in the vacuum chamber 68 is reduced to minutely adjust the degree of opening of the control valve 40 to prevent the degree of opening of the control valve 40 from being undesirably or excessively increased by the vacuum actuator 42 and to minutely adjust the amount of atmospheric air fed into the conduit 30 and the vacuum chamber 28. As a result, the vacuum chamber 28 is prevented from being fed with an excessive amount of atmospheric air which causes the EGR control valve 18 to abruptly close the EGR passage 16. When the air supply control valve 40 is operated to reduce the degree of opening thereof by a reduced intake manifold vacuum, the air supply control valve 40 is operated in its open direction by the second operating means 60, fed with a reduced amount of atmospheric air, to feed an appropriate amount of atmospheric air into the passage means 28. Thus, the EGR control valve 18 can accurately meter the amount of the engine exhaust gases fed into the intake passageway 10 to a predetermined ratio to the amount of air drawn into the engine.

Figure 4:
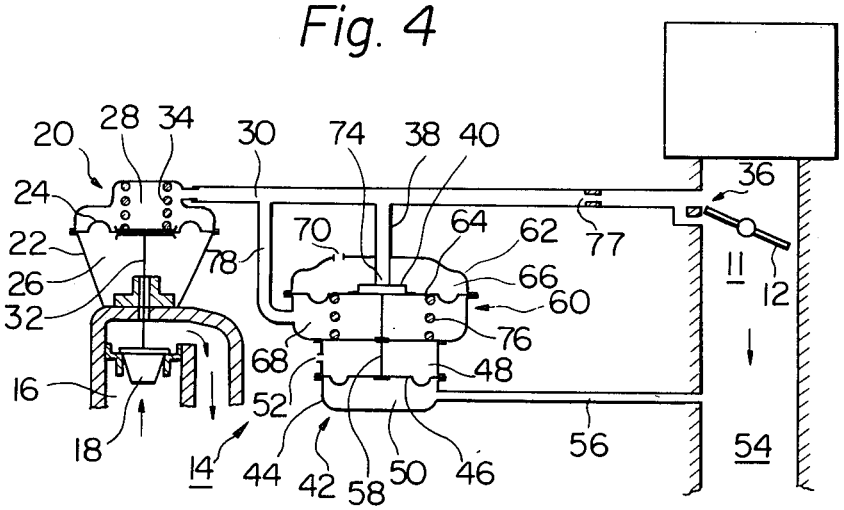
FIG. 4 is a schematic cross sectional view of a modification of the EGR system shown in FIG. 2.

Referring to FIG. 4 of the drawings, there is shown a modification of the EGR system 14 shown in FIG. 2. The modification differs from the EGR system 14 only in that a vacuum chamber 68 communicates with the passage means 30 at a position downstream of the junction between the passage means 30 and 38 through a conduit 78 so that the vacuum chamber 68 is fed with a vacuum somewhat reduced as compared with the EGR system 14.

Figure 5:
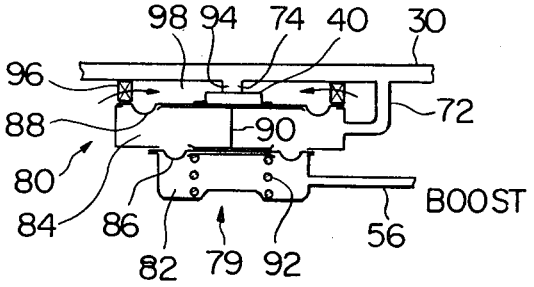
FIG. 5 is a schematic cross sectional view of the other example of combined first and second vacuum actuators forming part of the EGR system shown in FIG. 2.

Referring to FIG. 5 of the drawings, there is shown an improved example of combined first and second vacuum servos of an air supply control valve 40. As shown in FIG. 5, the first and second vacuum servos 79 and 80 are different from the first and second vacuum servos 42 and 60 shown in FIG. 2 in that the first vacuum servo 79 is provided with only a vacuum chamber 82 and is not provided with an atmospheric chamber so that the vacuum chamber 82 adjoins a vacuum chamber 84 of the second vacuum servo 80 and is separated from the vacuum chamber 84 by a flexible diaphragm 86. The diaphragm 86 is operatively connected to a flexible diaphragm 88 of the vacuum servo 80 through a connecting or operating rod 90. A spring 92 is located in the vacuum chamber 82 in lieu of in the vacuum chamber 84 and urges the diaphragm 86 toward a position in which the air supply control valve 40 closes passage means 94. An air filter 96 is provided in an inlet port of an atmospheric chamber 98 of the second servo 80.

It will be appreciated that the invention provides an improved exhaust gas recirculation system comprising a second vacuum servo which is operatively connected to an air supply control valve, controlling the amount of atmospheric air fed into a vacuum actuator of an EGR control valve, in addition to a first vacuum servo, and is operable, in response to the vacuum in the vacuum actuator reduced by the fed atmospheric air, to minutely adjust the degree of opening of the air supply control valve so that a proper or desirable amount of atmospheric air is fed into the vacuum actuator independently of the intake manifold vacuum being high and low to make it possible for the EGR control valve to accurately meter the amount of the engine exhaust gases fed into the intake passageway to a predetermined ratio to the amount of air drawn into the engine.

What is claimed is:

1. An exhaust gas recirculation system for an internal combustion engine, comprising an exhaust gas recirculation (EGR) passageway for feeding exhaust gases of said engine into an intake passageway of said engine, an exhaust gas recirculation (EGR) control valve disposed in said EGR passageway, a vacuum actuator operatively connected to said EGR control valve and having a first vacuum chamber subjected to the vacuum in said intake passageway adjacent to a throttle valve rotatably mounted therein, said EGR control valve being operable in response to the vacuum in said first vacuum chamber to control the amount of the engine exhaust gases fed into said intake passageway, passage means communicating with the atmosphere and with said first vacuum chamber to feed atmospheric air thereinto to reduce the vacuum in said first vacuum chamber, an air supply control valve associated with said passage means, a vacuum servo operatively connected to said air supply control valve and having a second vacuum chamber subjected to an intake passageway vacuum in said intake passageway downstream of said throttle valve, said air supply control valve being operable in response to the vacuum in said second vauum chamber to control the amount of atmospheric air fed into said first vacuum chamber, and operating means operatively connected to said air supply control valve and operable in response to the vacuum in said first vacuum chamber reduced by said atmospheric air fed to minutely adjust the degree of opening of said air supply control valve to minutely adjust the amount of atmospheric air fed into said first vacuum chamber to thereby make it possible for said EGR control valve to meter the amount of said engine exhaust gases fed into said intake passageway to a predetermined ratio to the amount of air drawn into said engine.

2. An exhaust gas recirculation system as claimed in claim 1, in which said operating means comprises a second vacuum servo including a housing and a flexible diaphragm operatively connected to said air supply control valve and dividing the interior of said housing into an atmospheric chamber communicating with the atmosphere and a third vacuum chamber communicating with said first vacuum chamber, said air supply control valve being moved in response to a decrease in the vacuum in said third vacuum chamber by said atmospheric air fed toward a position in which it closes said passage means.

3. An exhaust gas recirculation system as claimed in claim 2, in which said passage means extends into said atmospheric chamber of said second vacuum servo and said air supply control valve has its valve head which is located in said atmospheric chamber and to which said diaphragm is directly connected.

4. An exhaust gas recirculation system as claimed in claim 3, in which sid first vacuum servo includes a housing fixedly connected to said housing of said second vacuum servo, and a flexible diaphragm operatively connected to said diaphragm of said second vacuum servo and dividing the interior of said housing into said second vacuum chamber and an atmospheric chamber communicating with the atmosphere.

5. A combination of an internal combustion engine and an exhaust gas recirculation (EGR) system, said engine including an intake passageway having a throttle valve rotatably mounted therein and an exhaust gas passageway, said EGR system comprising an exhaust gas recirculation (EGR) passageway interconnecting said exhaust gas passageway and said intake passageway to feed exhaust gases of said engine thereinto, an exhaust gas recirculation (EGR) control valve disposed in said EGR passageway, a vacuum actuator operatively connected to said EGR control valve and having a first vacuum chamber, first passage means interconnecting said first vacuum chamber and said intake passageway adjacent to said throttle valve, said EGR control valve being operable in response to the vacuum in said first vacuum chamber to control the amount of the engine exhaust gases fed into said intake passageway, second passage means communicating with the atmosphere and with said first passage means to feed atmospheric air thereinto to reduce the vacuum in said first vacuum chamber, an air supply control valve associated with said second passage means, a vacuum servo operatively connected to said air supply control valve and having a second vacuum chamber communicating with said intake passageway downstream of said throttle valve, said air supply control valve being operable in response to the vacuum in said second vacuum chamber to control the amount of atmospheric air fed into said first passage means, and operating means operatively connected to said air supply control valve and operable in response to the vacuum in said first passage means reduced by said atmospheric air fed to minutely adjust the degree of opening of said air supply control valve to minutely adjust the amount of atmospheric air fed into said first vacuum chamber to thereby make it possible for said EGR control valve to meter the amount of said engine exhaust gases fed into said intake passagey to a predetermined ratio to the amount of air drawn into said engine.

6. A combination as claimed in claim 5, in which said first passage means communicates with said intake passageway at a position which is varied from upstream of said throttle valve into downstream thereof as the degree of opening of said throttle valve is increased.

7. A combination as claimed in claim 5, in which said operating means comprises a second vacuum servo including a housing and a flexible diaphragm operatively connected to said air supply control valve and dividing the interior of said housing into an atmospheric chamber communicating with the atmosphere and a third vacuum chamber communicating with said first passage means, said air supply control valve being moved in response to a decrease in the vacuum in said third vacuum chamber by said atmospheric air fed toward a position in which it closes said second passage means.

8. A combination as claimed in claim 7, in which said second passage means extends into said atmospheric chamber of said second vacuum servo and said air supply control valve has a valve head which is located in said atmospheric chamber of said second vacuum servo and to which said diaphragm of said air supply control valve is directly connected.

9. A combination as claimed in claim 8, in which said first vacuum servo includes a housing fixedly connected to said housing of said second vacuum servo, and a flexible diaphragm operatively connected to said diaphragm of said second vacuum servo and dividing the interior of said housing into said second vacuum chamber and an atmospheric chamber communicating with the atmosphere.

10. A combination as claimed in claim 8, in which said first vacuum servof includes a housing fixedly connected to said housing of said second vacuum servo and having therein a single chamber which is said second vacuum chamber, and a second flexible diaphragm interposed between said housings of said first and second vacuum servos to separate said second vacuum chamber from said first vacuum chamber and operatively connected to said diaphragm of said second vacuum servo.

* * * * *